US010123592B2

(12) United States Patent
Raymond

(10) Patent No.: US 10,123,592 B2
(45) Date of Patent: Nov. 13, 2018

(54) STRAP SECURED ATTACHMENT PROVIDING LOAD SUPPORT AND/OR ANTI ABRADING PROTECTION OF AN ARTICLE SUPPORTING SLING

(71) Applicant: CENTRAL LAKE ARMOR EXPRESS, INC., Central Lake, MI (US)

(72) Inventor: Charles C. Raymond, Mancelona, MI (US)

(73) Assignee: Central Lake Armor Express, Inc., Central Lake, MI (US)

( * ) Notice: Subject to any disclaimer, the term of this patent is extended or adjusted under 35 U.S.C. 154(b) by 0 days.

(21) Appl. No.: 13/644,441

(22) Filed: Oct. 4, 2012

(65) Prior Publication Data

US 2013/0086772 A1 Apr. 11, 2013

Related U.S. Application Data

(60) Provisional application No. 61/545,347, filed on Oct. 10, 2011.

(51) Int. Cl.
*A44B 99/00* (2010.01)
*A45F 5/02* (2006.01)
(Continued)

(52) U.S. Cl.
CPC ..... *A44B 99/00* (2013.01); *A45C 13/30* (2013.01); *A45F 5/02* (2013.01); *F41C 23/02* (2013.01); *F41C 33/007* (2013.01); *A45C 3/06* (2013.01); *A45F 2003/146* (2013.01); *A45F 2005/023* (2013.01); *Y10T 24/1374* (2015.01); *Y10T 24/1397* (2015.01)

(58) Field of Classification Search
CPC ..... A45F 5/021; A45F 5/02; A45F 2005/02; A44B 99/00; Y10T 24/3416; Y10T 24/342; Y10T 24/44983; Y10T 24/44658; Y10T 24/4465
USPC ... 24/2.5, 3.1, 318, 3.4, 3.13, 169, 199, 200, 24/370, 265 H; 224/268, 904, 269, 671, 224/672, 673, 677, 678, 195; 2/336; 450/86
See application file for complete search history.

(56) References Cited

U.S. PATENT DOCUMENTS 745,884 A * 12/1903 Morton ..... A44B 11/04 24/198
1,081,391 A * 12/1913 Lane ..... A47G 25/82 223/113

(Continued)

*Primary Examiner* — Robert Sandy
*Assistant Examiner* — Michael S Lee
(74) *Attorney, Agent, or Firm* — Marshall, Gerstein & Borun LLP

(57) ABSTRACT

A multi-functional article easily attachable to and adjustable along a strap, without having to either disassemble or modify the strap in any fashion. The attachment article includes a base configured with an interior cutout profile defining a pair of inwardly projecting tabs with contoured opposing edges configured to receive a strap in manipulated engaging fashion in order to mount the article to the strap. An integrally defined end portion extends from an edge of the base, typically in a reverse angled fashion, and defines a catch operable in multiple variants to either prevent abrading of a rifle sling, backpack strap, or the like as well as being operable in a further variant to provide a vertical load supporting article.

13 Claims, 5 Drawing Sheets

(51) Int. Cl.

| | |
|---|---|
| ***F41C 23/02*** | (2006.01) |
| ***F41C 33/00*** | (2006.01) |
| ***A45C 13/30*** | (2006.01) |
| *A45C 3/06* | (2006.01) |
| *A45F 3/14* | (2006.01) |

(56) References Cited

U.S. PATENT DOCUMENTS

| | | | | | |
|---|---|---|---|---|---|
| 1,134,176 | A * | 4/1915 | Beck | A44B 11/04 | 24/321 |
| 1,281,822 | A | 10/1918 | Orr | | |
| 1,477,408 | A * | 12/1923 | Williams | A47G 25/82 | 223/118 |
| 1,504,234 | A * | 8/1924 | Wyman | A41C 1/06 | 24/321 |
| 1,718,291 | A * | 6/1929 | Guenther | 24/199 | |
| 2,260,060 | A * | 10/1941 | Shaulson | A44B 11/04 | 24/200 |
| 2,264,957 | A * | 12/1941 | Shafarman | 223/87 | |
| 2,550,433 | A | 4/1951 | Tichenor | | |
| 2,748,390 | A | 6/1956 | Carlson | | |
| 2,970,316 | A | 2/1961 | Silin | | |
| 2,984,879 | A * | 5/1961 | Budd et al. | 24/199 | |
| 3,083,885 | A | 4/1963 | Ware | | |
| 3,436,000 | A * | 4/1969 | Batista | A47G 25/82 | 223/118 |
| 3,862,709 | A | 1/1975 | Roshaven | | |
| 3,940,039 | A | 2/1976 | Sasaki | | |
| 4,062,065 | A | 12/1977 | Gardner | | |
| 5,513,785 | A | 5/1996 | Campagna, Jr. | | |
| 5,632,068 | A * | 5/1997 | Riley et al. | 24/326 | |
| 5,964,642 | A * | 10/1999 | Fildan | 450/86 | |
| 6,363,532 | B1 | 4/2002 | Miller et al. | | |
| 2004/0154141 | A1 * | 8/2004 | Barnes | 24/198 | |
| 2004/0256426 | A1 | 12/2004 | Sanderson et al. | | |
| 2012/0298701 | A1 * | 11/2012 | Cannata | A47G 25/82 | 223/118 |

* cited by examiner

STRAP SECURED ATTACHMENT PROVIDING LOAD SUPPORT AND/OR ANTI ABRADING PROTECTION OF AN ARTICLE SUPPORTING SLING

CROSS-REFERENCE TO RELATED APPLICATIONS

The present application claims the priority of U.S. Ser. No. 61/545,347 filed Oct. 10, 2011.

FIELD OF THE INVENTION

The present invention is related to catch and sling supporting devices. More specifically, the invention discloses a load supporting and sling retention attachment which is capable of being adjustably employed with any number of straps, such as associated with a variety of garments in the law enforcement, military and recreational sports among these being vests, article webbing and the like, and which is capable of being "field mounted" without requiring disassembly of the vest or without alteration or damage to the straps.

BACKGROUND OF THE INVENTION

The prior art includes examples of retainer and holding devices for use in retaining a sling or strap. Among these are included the safety shoulder strap holder of Gardner, U.S. Pat. No. 4,062,065 which discloses a pin-type holder attached to a garment on the shoulder and having a hook portion for holding a strap of a shoulder bag. The hook portion is hingedly attached to the holder and becomes detachable in the instance of an excessive pulling force exerted upon the strap.

Another example of a retainer for a shoulder sling is depicted in U.S. Pat. No. 3,940,039, to Sasaki, and which includes an elongated main body with a button hole adjacent to one end thereof, a hook means securing to the other end of the body and defining a sling receiving hook piece.

A further example of a holder device configured to be worn on a body and for retaining such as a cable is depicted in Roshsven, U.S. Pat. No. 3,862,709 and provided in the form of a shoulder plate in combination with a plurality of straps disposed about the waist and upper portion of the wearer's body. The plate is slidably connected to one of the straps to permit its adjustment, with the remaining straps securely fastened about the body and a belt hook movably attached to the strap whereby the device may also be fastened to the wearer's belt.

Other references of note include the rifle sling support apparatus of Barron, U.S. Pat. No. 5,564,610 having a waist belt attachable securement strap to which is mounted an article supporting hook with angle adjustment means. Miller et al., U.S. Pat. No. 6,363,532 teaches a similarly configured rifle sling support for securing a rifle to the back of the user and which includes an engagement portion supported upon a nylon webbing, the engagement portion having elongated and overlapping inter-engaging portions for securing a location between the grip and stock of the rifle.

Further references of note include the shoulder weight carrier of Orr, U.S. Pat. No. 1,281,822, the strap holder for rifles of Ware, U.S. Pat. No. 3,083,885 and the gun sling retainer of Carlson, U.S. Pat. No. 2,748,390.

SUMMARY OF THE INVENTION

The present invention discloses a multi-functional attachment article which is easily attachable and adjustable relative to a strap without having to either disassemble or modify the strap in any fashion. The attachment article includes a base configured with an interior cutout profile exhibiting any of a number of potential profiles, such as without limitation, a pseudo "H" shape defining a pair of inwardly projecting tabs with contoured opposing edges, and which are configured to receive a strap in manipulated engaging fashion in order to mount the article to the strap. An integrally defined end portion extends from an edge of the base, typically in a reverse angled fashion, and defines a catch.

In a first application, the base is adapted to be engaged by a lower strap, with an upper strap overlaying the lower strap and base and resistively engaging the article via hook and loop fasteners arrayed between the engaging surfaces of the straps. The angle catch in this variant is often used in order to restrain such as a rifle sling from abrading or chafing the wearer's neck.

In a further application, the catch operates in a vertically oriented and load bearing capacity and such as which can be field mounted to an existing and horizontally arrayed strap or webbing location associated with a wearable vest. The attachment articles can be further employed in a paired arrangement associated with first and second backpack shoulder straps and which operates to prevent the shoulder straps from abrading the opposite sides of the wearer neck. A related variant contemplates a modified arrangement with first and second side straps reconfigured at the rear for supporting a firearm or the like.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is a perspective of the sling attachment in a first application with lower and upper straps and operating in an abrading prevention mode in use with a rifle sling or the like;

DETAILED DESCRIPTION OF THE PREFERRED EMBODIMENTS

Figure 3:
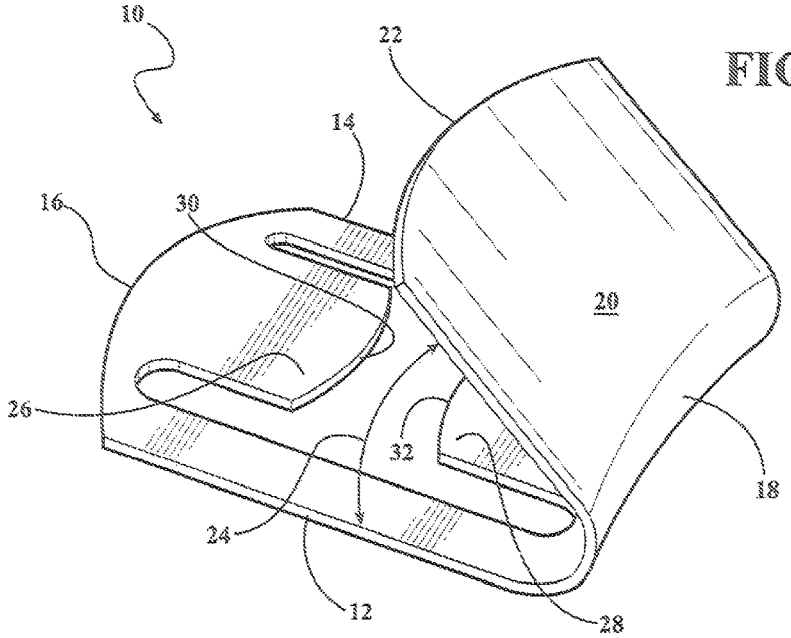
FIG. 3 is a first perspective view of the attachment article depicted in FIG. 1.
Figure 4:
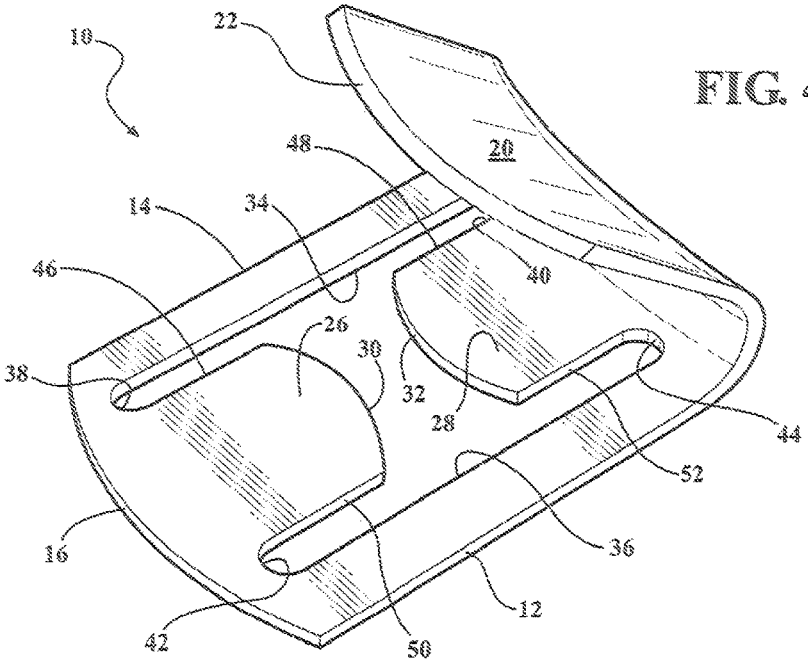
FIG. 4 is a second rotated perspective view of the attachment article.

With reference initially to FIGS. 3 and 4, the present invention discloses a multi-functional article, generally at 10, which is easily attachable and adjustable relative to a strap without having to either disassemble or modify the strap in any fashion. The article 10 is exhibited by a one-piece body which is typically a lightweight metal, typically painted or environmentally coated, or heavy-duty plastic composite.

Without limitation, the article 10 be initially provided as a flat-stock material which is stamped and bent to the desired configuration. Alternatively, the article can be injection molded or thermoformed in the instance of a plasticized matrix being used and in order to adapt to the desired shaping. Without limitation, the blank stock material which is configured to the eventual configuration 10 of the article can exhibit any dimensions, such as including but not limited to an overall length of 3", width of 2", height of 1.5" and with a thickness of 0.125" or greater, such dimensions being configured to support or restrain any sling or strap arrangement and without risk of deforming or bending the article.

The attachment article 10 includes a base which, as shown, exhibits a generally rectangular configuration including first and second sides 12 and 14 with a tapered forward edge 16. An opposite rear edge 18 of the base portion is adjoined by a reverse angled catch portion 20 which extends as a continuation of the sides 12 and 14 until terminating at an upwardly tapered edge 22.

Without limitation, the reverse angled catch portion 20 can adopt any acute angle relative to the surface of the base. In one non-limiting example, an angle of approximately 41° (see arrow 24) has been found to provide an optimal angle for restraining a sling or the associated with an object carried by the wearer and in order to prevent abrading contact by the sling along the wearers neck.

As further best depicted in each of FIGS. 3 and 4, the interior of the base is exhibited by a cutout profile, such as which is depicted without limitation by a pseudo "H" shape having a pair of inwardly projecting tabs 26 and 28 with contoured/tapered opposing edges 30 and 32. As further shown, the inner cutout profile shown includes outermost extending and inwardly facing perimeter sides 34 and 36 and inwardly corner extending contoured profiles 38, 40, 42 and 44 which merge into side adjoining edges 46 & 48 and 50 & 52 of the tabs 26 and 28. As further best shown in FIG. 4, the configuration of the tabs 26 and 28 is such that an appropriately width dimensioned strap (as will be subsequently described in each of FIGS. 1, 2, 5, 6 and 7) is capable of being manipulated within the apertures defining the cutout profile and so that it is restrained between the opposingly configured tabs 26 and 28 and the side extending portions (defined as the width defining dimensions between the outer sides 12 and 14 and the inner spaced surfaces 34 and 36.

Figure 1:
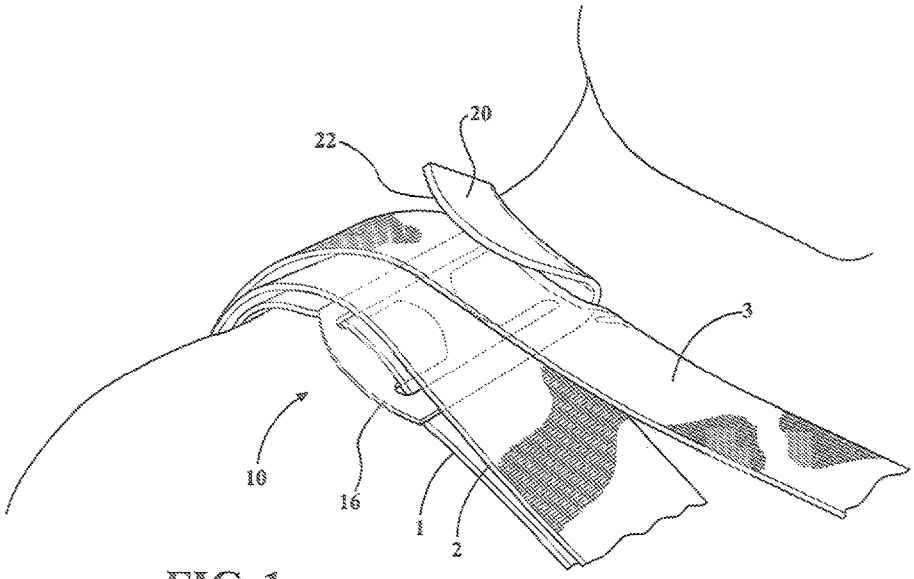
Figure 2:
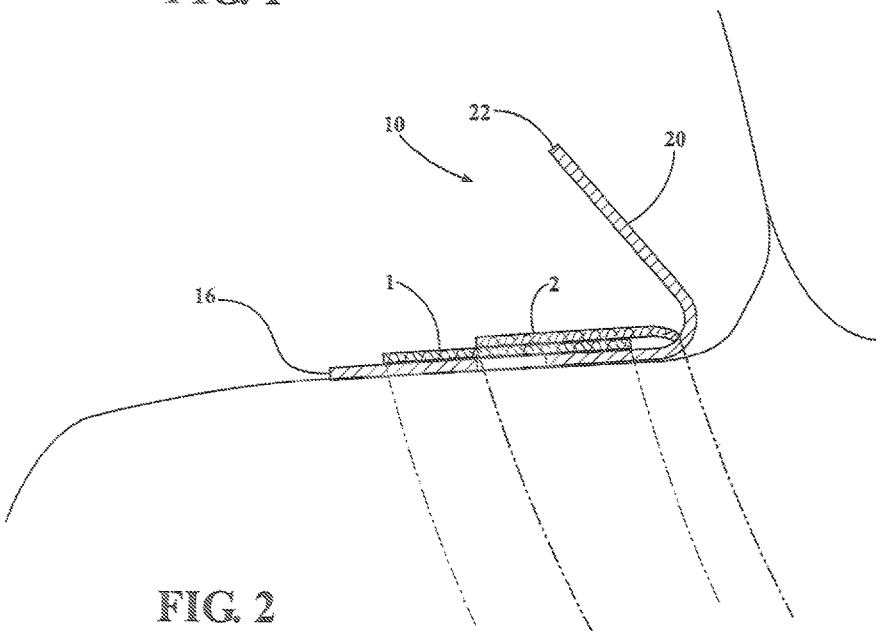
FIG. 2 is a side plan view of the attachment in FIG. 1 depicting a hook and loop engagement established between the straps with the attachment article secured in place.

Referring to FIGS. 1 and 2, both perspective and side plan views are shown of the sling attachment 10 in a first non limiting application in use with a lower strap 1 looped across or otherwise weaved or engaged to the base, with an upper folded over and hook and loop fastener engaged strap 2, such as which are associated with a standard ballistic vest and so that the attachment device operates in an abrading preventing mode in use with a rifle sling 3. It should be noted that the attachment device 10 is adapted for use in multiple strap configurations, not limited to those depicted herein, and in which the device can be field mounted to a strap or webbing portion (such as associated with a military vest, armor carrier or the like) without modification or damage. Without limitation, the article 10 could also be engaged to the upper strap 2 or, in an alternate example attached to a single strap.

In the first application, the base is again adapted to be engaged by the lower hook and loop engaging strap 1, with the upper and likewise hook and loop configured strap 2 overlaying the lower strap and base and resistively engaging the article in place between the engaging surfaces of the straps and so that the angled catch restrains such as a rifle sling from abrading or chafing the wearer's neck.

In a further application, the catch operates in a vertically oriented and load hearing capacity and such as which can be field mounted to an existing and horizontally arrayed strap or webbing location associated with a wearable vest. The attachment articles can be further employed in a paired arrangement associated with first and second backpack shoulder straps and which operates to prevent the shoulder straps from abrading the opposite sides of the wearer neck. A related variant contemplates a modified arrangement with first and second side straps reconfigured at the rear for supporting a firearm or the like.

Figure 5:
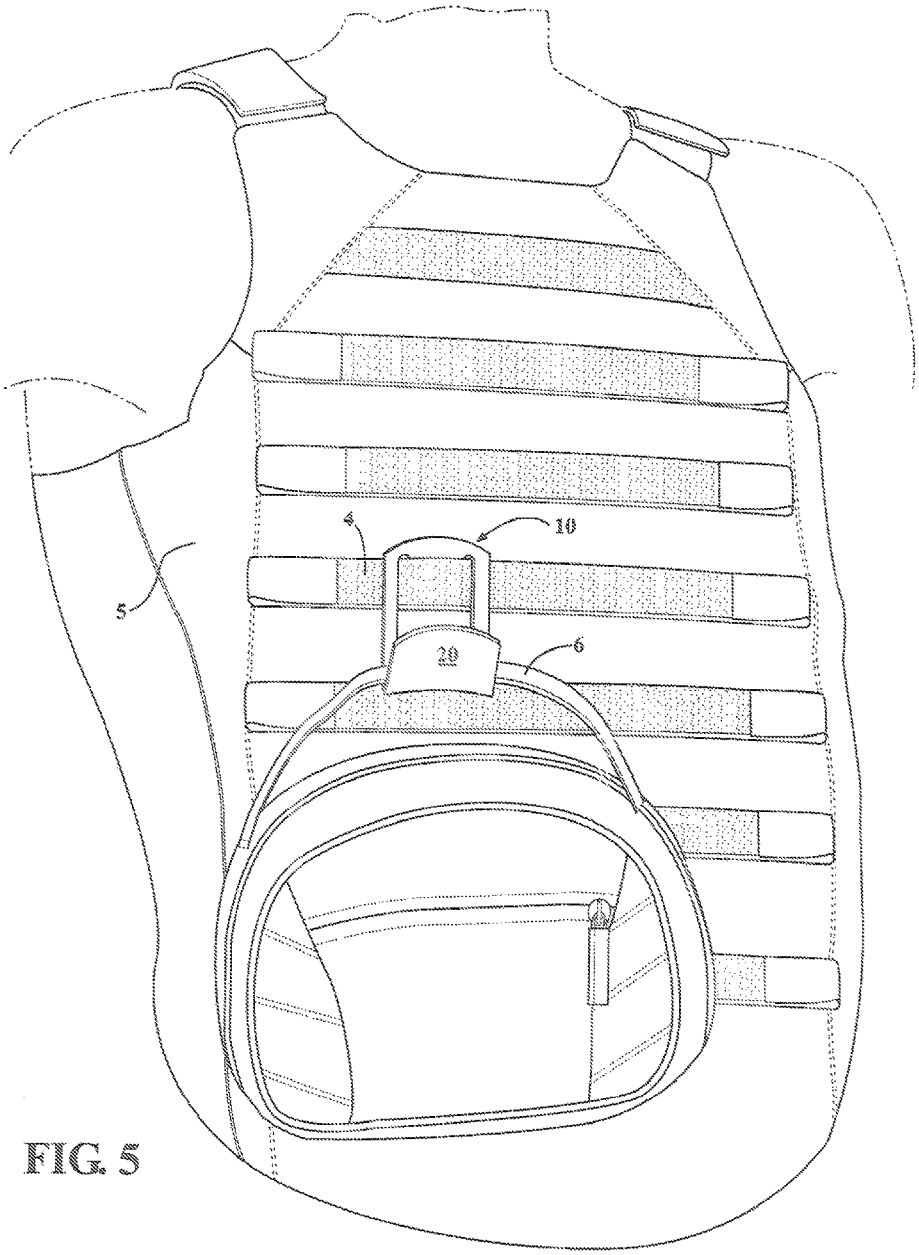
FIG. 5 is an operational illustration according to a second application of the attachment article secured to a horizontal vest webbing location in an article supporting variant.

Referring now to FIG. 5, an operational illustration is shown of a second application of the attachment article 10 secured to a horizontal vest webbing location 4, such as associated with a armor style vest 5, in an article supporting variant (see article with looped strap 6 which is secured by the catch portion 20 of the attachment 10.

Figure 6:
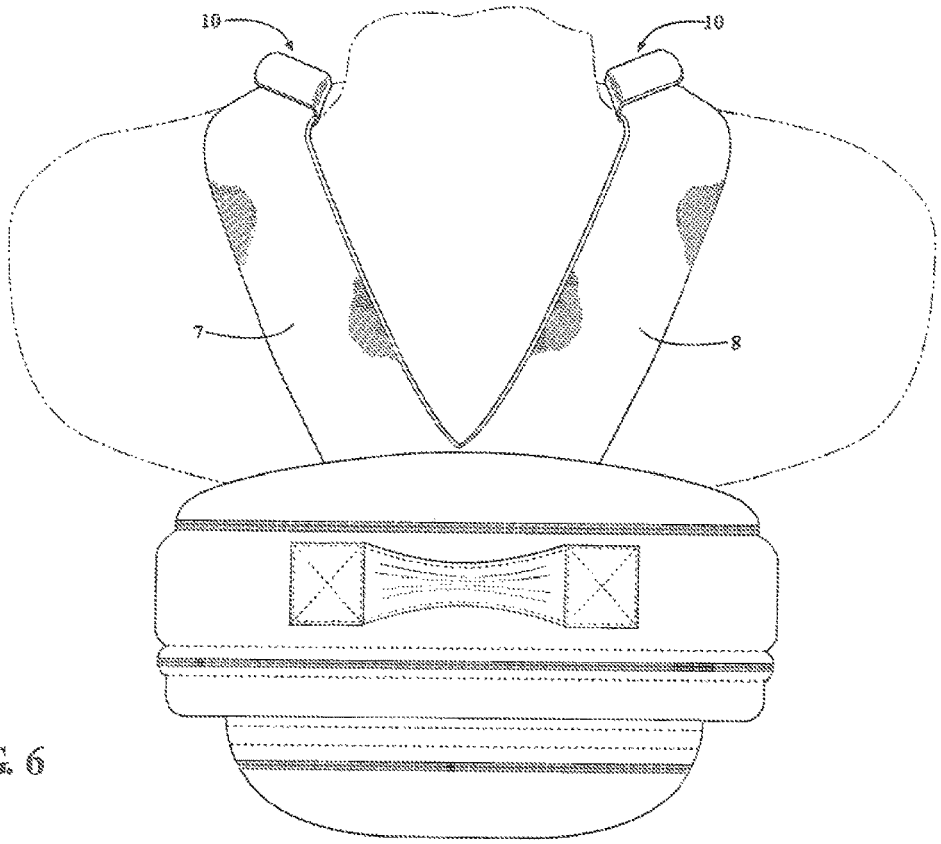
FIG. 6 is a further operational illustration according to a third application depicting a pair of articles secured to opposing first and second backpack shoulder straps and which operates to prevent the shoulder straps from abrading the opposite sides of the wearer neck.
Figure 7:
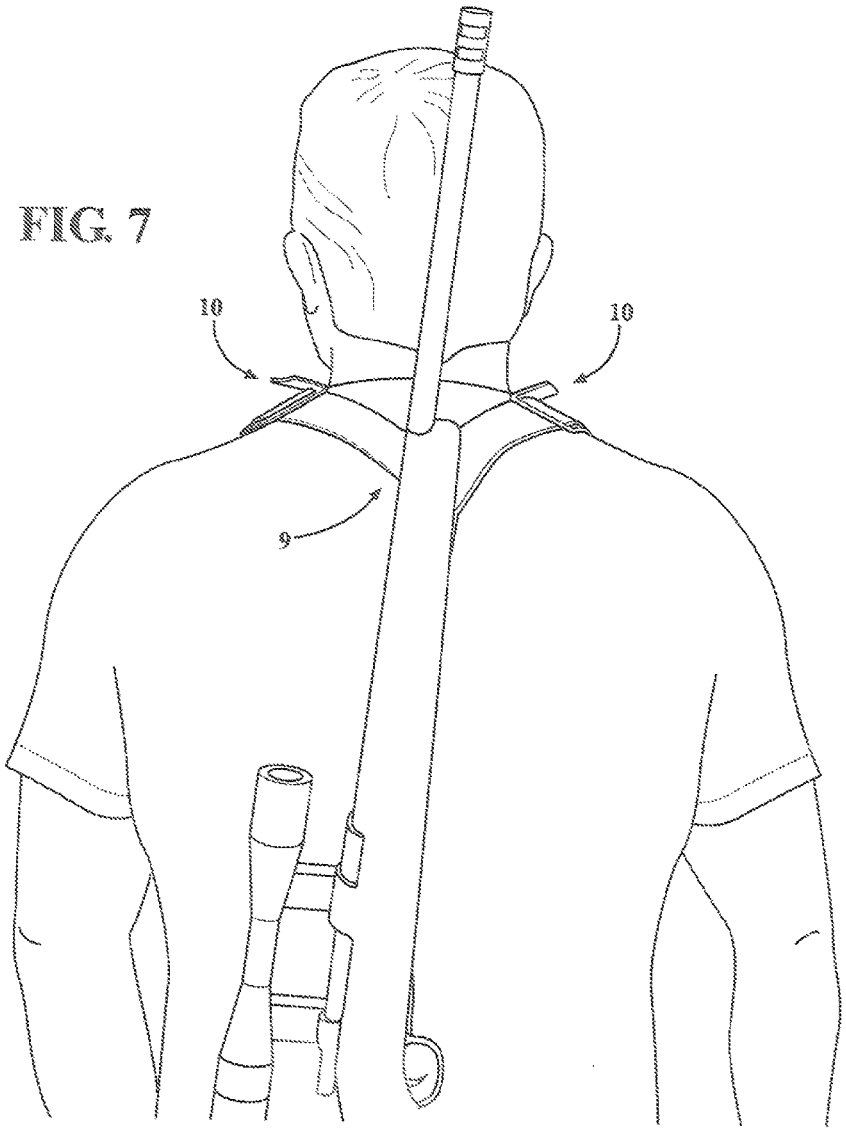
FIG. 7 is a yet further operational illustration of a subset application to that depicted in FIG. 6 and by which the straps are reconfigured for supporting a firearm or the like at a rear location between the wearer's shoulders.

FIG. 6 is a further operational illustration according to a third application depicting a pair of articles 10 secured to opposing first 7 and second 8 backpack shoulder straps, and which operates to prevent the shoulder straps from abrading the opposite sides of the wearer neck. Finally, FIG. 7 is a yet further operational illustration of a subset application to that depicted in FIG. 6 and by which the straps are reconfigured as generally shown at 9 for supporting a firearm or the like at a rear location between the wearer's shoulders.

In any of the variants previously depicted, the attachment 10 is capable of being quickly adjusted along the length of the associated strap to which it is mounted, and by virtue of the cutout configuration associated with its mounting base. In the instance of the rifle sling attachment variant of FIG. 1, the configuration of the attachment device 10 with angled catch 20 is further such that it does not interfere with the wearer's ability to load, draw, aim and fire the weapon supported by the sling 3 when needed.

Although not shown in the operational variant of FIGS. 1-2, the attachment device is capable of being reversed in engagement position with the strap(s) in order to retain any of hoses, cables, backpack straps or the like from falling off the user's shoulders (this additional to the primarily vertical load bearing arrangement depicted in FIG. 5 such as in use with MOLLE webbing for allowing the user to hang miscellaneous items from the vest or like garment).

Having described my invention, other and additional preferred embodiments will become apparent to those skilled in the art to which it pertains, and without deviating from the scope of the appended claims.

I claim:

1. An attachment article to be worn by a wearer to protect a portion of a body of the wearer from abrasion, comprises:

a body which comprises:

a planar base which comprises a wall portion which includes a cutout, a rear edge and a forward edge with the planar base extending between the forward edge and the rear edge; and a catch portion which comprises a wall portion which includes a first side and a second side and the wall portion of the catch portion is adjoined with the rear edge of the wall portion of the base, wherein:

the wall portion of the catch portion extends in an angular direction relative to the wall portion of the base;

the wall portion of the catch portion defines a surface which faces in a direction away from the planar base and which extends in a nonlinear direction between the first side and the second side of the wall portion of the catch portion defining a recess which faces away from the base;

the rear edge of the wall portion of the base extends in a curvilinear direction as the rear edge extends along the wall portion of the planar base between the first side and the second side; and the wall portion of the planar base defines an interior cutout profile, which comprises:

a pair of tabs;

the pair of tabs extend in a direction toward one another;

an end portion of a first tab of the pair of tabs defines an edge and another end portion of a second tab of the pair of tabs defines another edge such that the edge faces the other edge; and the edge of the first tab is positioned spaced apart from the other edge of the second tab defining a space between the first tab and the second tab.

2. The attachment article of claim 1, wherein the nonlinear direction comprises a curvilinear direction.

3. The attachment article of claim 1, wherein:

the cut out profile further defines a first perimeter side which extends in a direction spaced apart from and along a first side of the first tab, extends beyond the first tab to a position spaced apart from a first side of the second tab and extends in a direction spaced apart from and along the first side of the second tab; and the cut out profile defines a second perimeter side which extends in a direction spaced apart from and along a second side of the first tab, extends beyond the first tab to a position spaced apart from the second tab and extends in a direction spaced apart from and along the second side of the second tab, such that a strap can be extended through the interior cut out profile of the planar base along first perimeter side so as to extend the strap across the first and second tabs and extend the strap through the interior cut out profile of base along second perimeter side allowing the attachment article to be adjustably positioned along the securement strap.

4. The attachment article of claim 1, wherein the forward edge of the wall portion of the planar base is tapered and the wall portion of the catch portion defines an edge that is tapered.

5. The attachment article of claim 1 wherein the wall portion of the catch portion forms an acute angle with the wall portion of the planar base.

6. A load carrying system, comprising:

a garment comprising a webbing secured to the garment and positioned to extend in a direction across a width of the garment;

an attachment article, comprises:

a body, which comprises:

a base which comprises a wall portion which includes a forward edge and a rear edge and defines an interior cutout profile positioned between the forward edge and the rear edge which permits the webbing to extend through the base such that the base is adjustable relative to the webbing and the webbing supports the base; and a catch portion which comprises a wall portion is adjoined with the rear edge of the wall portion of the base wherein:

the wall portion of the catch portion includes a first side and a second side;

the wall portion of the catch portion extends in an angular direction relative to the wall portion of the base forming an acute angle with the base;

the rear edge of the wall portion of the base is positioned below the wall portion of the catch portion with the base positioned overlying the garment; wherein, the body comprises at least one of:

the rear edge of the wall portion of the base extends in a nonlinear direction as the rear edge extends along the wall portion of the catch portion with the wall portion extending between the first side and the second side; or the wall portion of the catch portion extends in a nonlinear direction between the first and second side of the wall portion of the catch portion.

7. The load carrying system of claim 6, further including a plurality of webbings wherein adjacent webbings are positioned spaced apart from one another.

8. The load carrying system of claim 6, wherein the webbing is positioned in a horizontal orientation.

9. The load carrying system of claim 6, wherein the interior cutout profile comprises:

a pair of tabs;

the pair of tabs extend in a direction toward one another;

an end portion of a first tab of the pair of tabs defines an edge and another end portion of a second tab of the pair of tabs defines another edge such that the edge faces the other edge; and the edge of the first tab is positioned spaced apart from the other edge of the second tab defining a space between the first tab and the second tab.

10. The load carrying system of claim 9, wherein:

the cut out profile further defines a first perimeter side which extends in a direction spaced apart from and along a first side of the first tab, extends beyond the first tab to a position spaced apart from a first side of the second tab and extends in a direction spaced apart from and along the first side of the second tab; and the cut out profile defines a second perimeter side which extends in a direction spaced apart from and along a second side of the first tab, extends beyond the first tab to a position spaced apart from the second tab and extends in a direction spaced apart from and along the second side of the second tab, such that the webbing can be extended through the interior cut out profile of the base along first perimeter side so as to extend the webbing across the first and second tabs and extend the webbing through the interior cut out profile of base along second perimeter side allowing the attachment article to be adjustably positioned along the webbing.

11. The load carrying system of claim 6, wherein the edge of the wall portion of the catch portion is tapered.

12. The load carrying system of claim 6, wherein the nonlinear direction in which the rear edge extends includes a curvilinear direction.

13. The load carrying system of claim 6, wherein the wall portion of the catch portion comprises a surface in which the surface faces away from the base, extends in a curvilinear direction between the first side and the second side of the wall portion of the catch portion and defines a recess between the first side and the second side of the wall portion of the catch portion.

* * * * *